US008153185B2

(12) United States Patent
Ookoba

(10) Patent No.: US 8,153,185 B2
(45) Date of Patent: Apr. 10, 2012

(54) METHOD OF FORMING SPACER

(75) Inventor: Minoru Ookoba, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 12/472,851

(22) Filed: May 27, 2009

(65) Prior Publication Data

US 2009/0298375 A1 Dec. 3, 2009

(30) Foreign Application Priority Data

Jun. 3, 2008 (JP) ..... 2008-145297

(51) Int. Cl.
*B05D 5/06* (2006.01)

(52) U.S. Cl. ..... 427/64; 445/24

(58) Field of Classification Search ..... None
See application file for complete search history.

(56) References Cited

U.S. PATENT DOCUMENTS 6,194,119 B1 * 2/2001 Wolk et al. ..... 430/200

FOREIGN PATENT DOCUMENTS

JP 2000-243274 A 9/2000
JP 2004-127949 A 4/2004

* cited by examiner

*Primary Examiner* — Monica A Huson

(74) *Attorney, Agent, or Firm* — Fitzpatrick, Cella, Harper & Scinto

(57) ABSTRACT

It is an object to enable sharp-cornered concave/convex portions to be easily formed when forming a spacer 7 for an electron-beam light-emitting display panel. A composition containing a second resin solution using a solvent in which a first resin cannot be dissolved and a spacer material is applied onto a first intermediate layer 9 constructed by the spacer material and the first resin and dried, thereby forming a second intermediate layer 11 constructed by the spacer material and the second resin. After an obtained laminated layer was patterned into a first plane shape, the first intermediate layer 9 is patterned into a second plane shape thinner than the first plane shape by using a solvent in which the first resin can be dissolved and the second resin cannot be dissolved and is baked, thereby forming the spacer.

4 Claims, 7 Drawing Sheets

METHOD OF FORMING SPACER

BACKGROUND OF THE INVENTION

1. Field of the Invention

The present invention relates to a method of forming spacers onto substrates constructing an electron-beam light-emitting display panel.

2. Description of the Related Art

A method of forming a spacer for a plasma display panel onto substrates by using two or more compositions in which solubilities to a developing solution are different has been known in the related art (for example, refer to Patent Document 1). That is, there has been known a method whereby the compositions are laminated from the substrate side so that the solubility to the same developing solution decreases sequentially, a resist pattern is formed onto the laminated layer, thereafter, a developing process is executed by using the developing solution which is common for each layer, and the pattern of the laminated layer thus obtained is baked, thereby forming the spacer. According to the above method, such a phenomenon that an upper layer which is come into contact with the developing solution for a time longer than that for a lower layer is excessively side-etched and its front edge becomes a thin shape can be prevented and the spacer having a large aspect ratio can be formed.

A method whereby a spacer which has concave/convex portions on a side surface and is used for an electron-beam light-emitting display panel is manufactured by casting has also been known (for example, refer to Patent Document 2). By forming the concave/convex portions onto the side surface of the spacer, a creepage distance is extended and a charge due to a secondary electron emission is suppressed, thereby enabling a creepage discharge to be easily prevented.

[Patent Document 1] Official Gazette of Japanese Patent Application Laid-Open No. 2004-127949

[Patent Document 2] Official Gazette of Japanese Patent Application Laid-Open No. 2000-243274

However, according to the method disclosed in Patent Document 1 mentioned above, for example, as shown in Paragraph [0025] of Patent Document 1, it is fundamentally intended to obtain the spacer with a cross sectional structure having the side surface that is perpendicular to the substrate and it is never intended to apply the concave/convex shape to the side surface of the spacer.

On the other hand, in the case of forming the concave/convex shape to the spacer for the electron-beam light-emitting display panel, if the sharp-cornered concave/convex shape is formed and, particularly, a lower surface of the convex portion is projected almost in parallel with a substrate surface, it is liable to suppress an emission of a secondary electron accompanied with an incidence of an electron. The creepage distance can be extended longer than that in the case where the lower surface of the convex portion is gently inclined.

However, the concave/convex portions which are formed onto the spacer for the electron-beam light-emitting display panel are the microfine portions and according to the casting disclosed in Patent Document 2, there is such a problem that the sharp-cornered concave/convex shape cannot be formed because of a limitation of die reproducibility. Specifically speaking, as illustrated in FIG. 3 of Patent Document 2, the concave/convex portions which are formed run wavily. There is, consequently, such a problem that an emission suppressing effect of the secondary electron and an increasing effect of the creepage distance are inferior to those in the case of forming the sharp-cornered concave/convex portions.

SUMMARY OF THE INVENTION

It is an object of the invention to enable a sharp-cornered concave/convex shape to be easily formed when forming a spacer for an electron-beam light-emitting display panel.

To accomplish the above object, according to the invention, there is provided a method of forming a spacer on substrates constituting an electron-beam light-emitting display panel, the method comprising: a step (A) of applying a first composition including a spacer material and a first resin solution by a first solvent onto the substrate; a drying step (B) of producing a first intermediate layer by removing the first solvent from a coating film of the first composition; a step (C) of applying a second composition including the spacer material and a second resin solution by a second solvent in which the first resin cannot be dissolved, onto the first intermediate layer; a drying step (D) of producing a second intermediate layer by removing the second solvent from a coating film of the second composition; a step (E) of patterning a laminated layer of the first intermediate layer and the second intermediate layer into a first plane shape; a step (F) of patterning the first intermediate layer or the second intermediate layer, patterned into the first plane shape, into a second plane shape which is thinner than the first plane shape by a wet etching method which uses a solvent in which the first resin can be dissolved and the second resin cannot be dissolved or a solvent in which the first resin cannot be dissolved and the second resin can be dissolved; and a step (G) of baking the pattern of the laminated layer of the first intermediate layer and the second intermediate layer.

In the solvent of the second composition which is used in the step (C) in the invention, although the second resin can be dissolved, the first resin cannot be dissolved. Therefore, when the second composition is applied onto the first intermediate layer, such a situation that the first resin in the first intermediate layer is dissolved and mixed to the second composition does not occur. The first intermediate layer and the second intermediate layer are laminated in such a manner that a surface between an upper surface and a lower surface which are overlaid in almost parallel onto the substrate surface is set to an interface surface.

After the laminated layer in the laminating state was patterned into the first plane shape in the step (E), the first intermediate layer is patterned into the second plane shape by using the solvent in which the first resin can be dissolved and the second resin cannot be dissolved in the step (F). Thus, a part of the lower surface of the second intermediate layer having the first plane shape which is thicker than the second plane shape is exposed. The second intermediate layer having the first plane shape which is thicker than the second plane shape forms the convex portion. The concave/convex shape in which the lower surface of the convex portion is exposed in almost parallel with the substrate surface is obtained. When the second intermediate layer is patterned into the second plane shape by using the solvent in which the first resin cannot be dissolved and the second resin can be dissolved in the step (F), a part of the upper surface of the first intermediate layer having the first plane shape which is thicker than the second plane shape is exposed. The first intermediate layer having the first plane shape which is thicker than the second plane shape forms the convex portion. The concave/convex shape in which the upper surface of the convex portion is exposed in almost parallel with the substrate surface is obtained. Since the solvent in which one of the first resin and the second resin can be dissolved and the other cannot be dissolved is used in the patterning in the step (F), a boundary between the portion which has been dissolved, has become the second plane shape, and constructs the concave portion and the portion which constructs the convex portion while keeping the first plane shape without being dissolved becomes clear, so that the sharp-cornered concave/convex shape is formed.

Since the laminated layer of the first intermediate layer and the second intermediate layer in the concave/convex state as mentioned above is obtained, the spacer which is obtained by baking the laminated layer in the step (G) also has the concave/convex state according to the above concave/convex state. The spacer having a high creepage discharge preventing effect can be obtained. In the case where the surface exposed almost in parallel with the substrate surface faces a substrate (rear plate) having electron-emitting sources, the secondary electron emission that is caused by the electron which enters directly from the electron-emitting source can be suppressed. In the case where the surface exposed almost in parallel with the substrate surface faces a substrate (face plate) having phosphor, the secondary electron emission that is caused by the electron which is reflected by the face plate and enters can be suppressed.

As illustrated in FIG. 24, it has been confirmed from experiments that an escape probability of electrons decreases extremely when a concavity angle (angle between a side surface of the concave portion or convex portion and a bottom surface of the concave portion or a vertex surface of the convex portion) approaches near 900. When considering the case of merely decreasing the escape probability of electrons, it is desirable to set the concavity angle to a value less than 90°. However, if the concavity angle is less than 90°, it is extremely difficult to form the concave portion. Therefore, actually, the angle of 90° is the optimum angle in order to satisfy both of the improvement of a creepage discharge voltage and the realization of a forming process.

In the invention, "vertical" denotes a laminating direction of the first intermediate layer and the second intermediate layer onto the substrate, the substrate side indicates the lower side, and its opposite side indicates the upper side.

Further features of the present invention will become apparent from the following description of exemplary embodiments with reference to the attached drawings.

DESCRIPTION OF THE EMBODIMENTS

The invention will be further described hereinbelow with reference to the drawings.

First, an example of an electron-beam light-emitting display panel having a spacer formed by the invention will be described with reference to FIG. 1.

Figure 1:
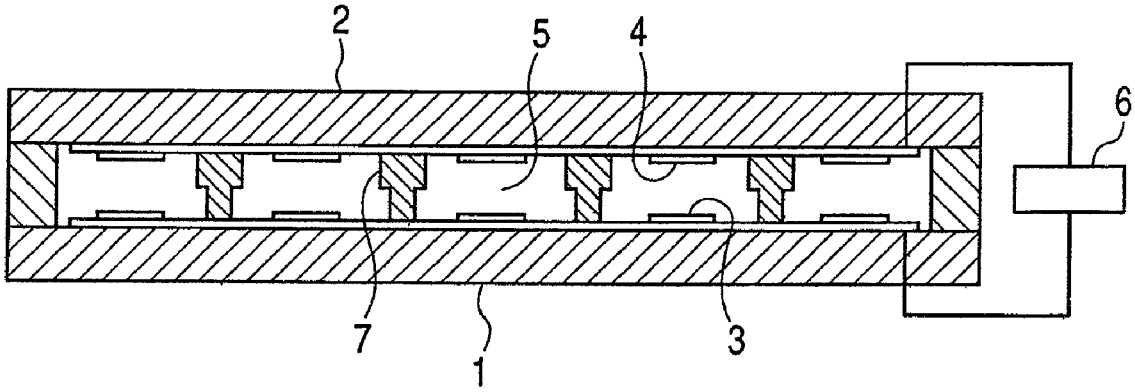
FIG. 1 is a schematic cross sectional view illustrating an example of an electron-beam light-emitting display panel having a spacer formed by the invention.

As illustrated in FIG. 1, a substrate 1 and a substrate 2 are arranged so as to face in parallel with each other. Electron-emitting sources 3 are formed on the substrate 1. The substrate 1 constructs a rear plate having the electron-emitting sources 3. A plurality of phosphor 4 each of which emits light by an irradiation of an electron and forms an image are formed on the substrate 2. The substrate 2 constructs a face plate having phosphor 4.

A space 5 between the substrates 1 and 2 is vacuum-sealed. The electron is emitted into the space 5 from the electron-emitting sources 3, a voltage is applied between the substrates 1 and 2 by an external power source 6, and the electron is accelerated by an electric field formed by the applied voltage. The accelerated electron is made to collide with phosphor 4 of the substrate 2 side so as to excite phosphor 4 and emit light therefrom, thereby displaying the image.

Spacers 7 are located between the substrates 1 and 2 and plays various kinds of roles such as decision of an interval between the substrates 1 and 2, prevention of a halation, and the like.

Subsequently, a first example of a manufacturing method of the spacer according to the invention will be described with reference to FIGS. 1 to 11.

The manufacturing method of the example sequentially executes the steps (A) to (G), which will be described hereinbelow, and will be described hereinbelow in order of the steps.

[1] Step (A)

Figure 2:
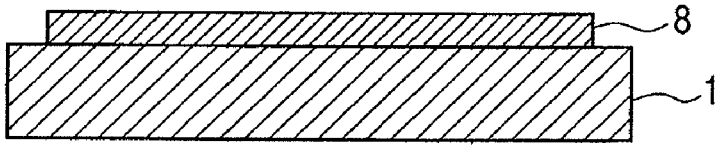
FIG. 2 is a descriptive diagram of a step (A) in a first method of the invention.

In the step (A), a first composition containing a spacer material and a first resin solution by a first solvent is applied onto the substrate 1 constructing the display panel as illustrated in FIG. 2. In the first example, a case of forming the spacers 7 onto the substrate 1 constructing the rear plate described in FIG. 1 will be described as an example. However, the spacers 7 can be also formed onto the substrate 2 constructing the face plate. A coating film 8 of the first composition is illustrated in FIG. 2.

The spacer material is a material constructing the spacer 7 (refer to FIGS. 1 and 10) by the baking of the step (G). Since the spacer 7 is a member disposed in a vacuum container, it is desirable that a material in which a degassing or the like is small is used as a spacer material constructing the spacer. It is presumed that the electron directly enters the spacer 7 from the electron-emitting source 3 described in FIG. 1 or the electron is reflected from the substrate 2 side as a face plate and then enters. Therefore, it is desirable to use a material which is not dissolved by the incidence of the electron as a spacer material. It is particularly desirable to use an inorganic material.

Since the spacer 7 is located between the substrates 1 and 2 as described in FIG. 1, a voltage is applied. If the material of the spacer 7 is a low-resistance material, a large current flows by the voltage between the spacers 7, resulting in an increase in electric power consumption and a heat generation. Therefore, it is desirable to use a high-resistance substance or an insulating substance as a spacer material.

As a specific example of the spacer material, a glass frit of a low melting point or the like can be mentioned since it satisfies required characteristics for the above material. For example, the following materials can be mentioned as a glass frit of the low melting point.

Glass frit of a mixture system of zinc oxide, boron oxide, and silicon oxide ($ZnO—B_2O_3—SiO_2$ system)

Glass frit of a mixture system of lead oxide, boron oxide, and silicon oxide ($PbO—B_2O_3—SiO_2$ system)

Glass frit of a mixture system of lead oxide, boron oxide, silicon oxide, and aluminum oxide ($PbO—B_2O_3—SiO_2—Al_2O_3$ system)

Glass frit of a mixture system of lead oxide, zinc oxide, boron oxide, and silicon oxide ($PbO—ZnO—B_2O_3—SiO_2$ system)

As a first resin, for example, a cellulosic resin such as nitrocellulose, ethylcellulose, hydroxy ethylcellulose, or the like can be mentioned. An acrylic resin such as polybutylacrylate, polymethacrylate, or the like, an acrylic copolymer, polyvinylalcohol, polyvinylbutyral, or the like can be also mentioned. Those materials can be used solely or two or more kinds of them can be also mixed and used.

The first resin constructs the first composition as a solution of the first solvent in such a manner that when the coating film 8 of the first composition is dried, the resin is uniformly distributed as a whole.

As a first solvent which forms the solution of the first resin, a solvent which can form the solution according to the selected first resin is selected. For example, water or an organic solvent can be used. As an organic solvent, for example, an alcohol class, an ether class, an ester class, an etherester class, a ketone class, a ketoneester class, an amide class, an amideester class, a lactam class, a lactone class, a sulfone class, a hydrocarbon class, a halogenated hydrocarbon class, or the like can be mentioned.

Further, specifically speaking, for example, the following material can be mentioned: water; ethanol; isopropyl alcohol; methanol; tetrahydrofuran; anisole; dioxane; an ethyleneglycol monoalkyl ether class; a diethyleneglycol monobutyl ether class; a diethyleneglycol monobutyl ether acetate class; a diethyleneglycol dialkyl ether class; a propyleneglycol monoalkyl ether class; a propyleneglycol dialkyl ether class; an ester acetate class; a hydroxy ester acetate class; an alkoxy ester acetate class; a propionic ester acetate class; a hydroxy propionic ester acetate class; an alkoxy propionic ester acetate class; a lactic acid ester class; an ethyleneglycol monoalkyl ether acetate class; a propyleneglycol monoalkyl ether acetate class; an alkoxy ester acetate class; a cyclic ketone class; an acyclic ketone class; an acetoacetic ester class; a pyruvate ester class; an N,N-dialkyl formamide class; an N,N-dialkyl acetamide class; an N-alkyl pyrolidone class; a γ-lactone class; a dialkyl sulfoxide class; a dialkyl sulfone class; terpineol; texanol; N-methyl-2-pyrolidone; or the like. Those water or organic solvents can be used solely or two or more kinds of them can be also mixed and used.

An additive such as adhesive assistant, preservation stabilizer, antifoaming agent, oxidation inhibitor, ultraviolet absorbent, filler, phosphor, pigment, dye, or the like can be added as necessary to the first composition which is used in the invention.

It is desirable to set mixture ratios of the spacer material and the first resin in the first composition in such a manner that the spacer material is equal to 100 weight parts and the first resin is equal to 1 to 50 weight parts, much desirably, 1 to 40 weight parts in order to control a shape deformation that is caused by volume contraction. A ratio of the first solvent is properly decided so as to obtain a flowability or flexibility suitable to form a coating film by applying the first composition onto the substrate 1.

The process for applying the first composition onto the substrate 1 can be executed by, for example, a general wet coating method such as a spin coating method, a printing method, a dipping (Dip) method, a doctor blade method, or the like.

[2] Step (B)

Figure 3:
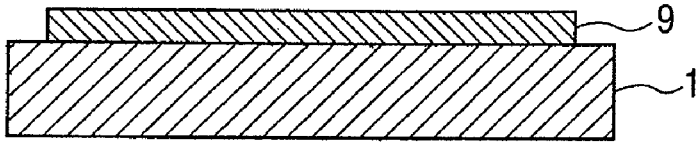
FIG. 3 is a descriptive diagram of a step (B) in the first method of the invention.

The step (B) is a drying step of removing the first solvent from the coating film 8 of the first composition and forming a first intermediate layer 9 illustrated in FIG. 3.

A drying temperature is ordinarily set to a temperature within a range from the normal temperature to about 200° C. although it depends on a boiling point of the first solvent, and it is desirable to decide the drying temperature so that the sufficient drying process can be performed for 1 to 20 minutes so as to obtain a good productivity.

[3] Step (C)

Figure 4:
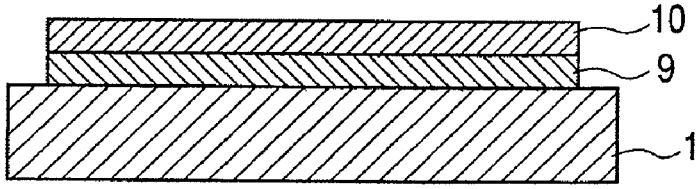
FIG. 4 is a descriptive diagram of a step (C) in the first method of the invention.

The step (C) is a step of applying a second composition containing the spacer material and a second resin solution by a second solvent in which the first resin cannot be dissolved onto the first intermediate layer 9 as illustrated in FIG. 4. A coating film 10 of the second composition is illustrated in FIG. 4.

As materials of the spacer material, the second resin, and the second solvent constructing the second composition, some of substances similar to those mentioned as a spacer material, a first resin, and a first solvent constructing the first composition mentioned above can be selected. However, the solvent in which the resin selected as a first resin cannot be dissolved is selected as a second solvent. The second resin is a resin which is dissolved into the solvent in which the resin selected as a first resin cannot be dissolved and can form a solution. That is, the second resin becomes inevitably a resin different from the resin selected as a first resin.

Mixture ratios of the spacer material and the second resin in the second composition and a mixture ratio of the second solvent are similar to those in the first composition. An additive similar to that used in the first composition can be also added in the second composition.

The process for applying the second composition onto the first intermediate layer 9 can be executed by the general wet coating method in a manner similar to the step (A) mentioned above.

[4] Step (D)

Figure 5:
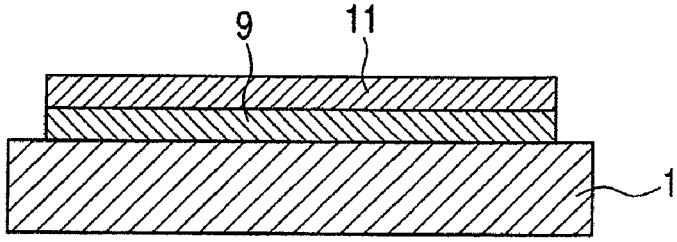
FIG. 5 is a descriptive diagram of a step (D) in the first method of the invention.

The step (D) is a drying step of removing the second solvent from the coating film 10 of the second composition and forming a second intermediate layer 11 illustrated in FIG. 5. This drying process can be executed in a manner similar to the step (B) mentioned above.

[5] Step (E)

The step (E) is a step of patterning a laminated layer of the first intermediate layer 9 and the second intermediate layer 11 into a first plane shape. There are a method of separately executing the patterning process by two stages and a method of executing the patterning process by one stage in the step (E). First, the method of separately executing the patterning process by two stages will be described.

Figure 6:
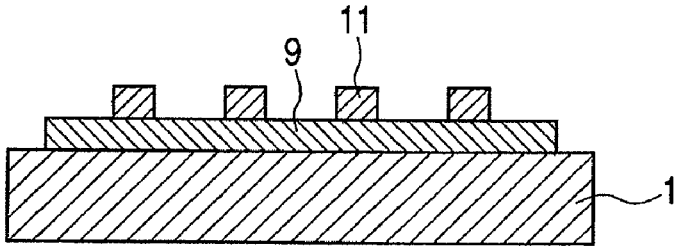
FIG. 6 is a descriptive diagram of a step (E) in the first method of the invention.
Figure 7:
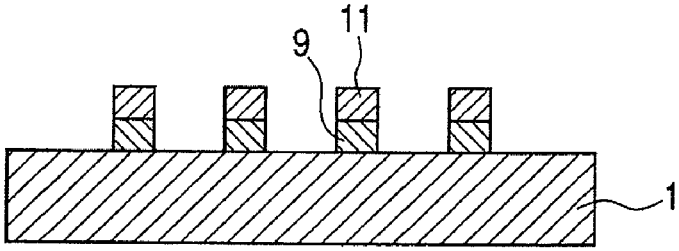
FIG. 7 is a descriptive diagram of the step (E) in the first method of the invention.

In the case of separately executing the step (E) by two stages, the second intermediate layer 11 is patterned into the first plane shape by the wet etching method of the first stage using the solvent in which the second resin can be dissolved and the first resin cannot be dissolved. The wet etching of the first stage can be executed by a method whereby a resist film is formed onto the second intermediate layer 11 by using a dry film or a liquid resist, the resist film is exposed through a photomask and developed, a mask is formed, and thereafter, an etching is performed by using the above solvent. By the wet etching method of the first stage, the first intermediate layer 9 in a region other than the region corresponding to the second intermediate layer 11 of the first plane shape is exposed, thereby obtaining a state as illustrated in FIG. 6. After that, the second intermediate layer 11 of the first plane shape is used as a mask and the wet etching method of the second stage using the solvent in which the first resin can be dissolved and the second resin cannot be dissolved is executed. Thus, the first intermediate layer 9 is patterned into the first plane shape and both of the first intermediate layer 9 and the second intermediate layer 11 are set into the first plane shape as illustrated in FIG. 7.

In the case of executing the step (E) by one stage, it can be executed by the wet etching method using the solvent in which both of the first resin and the second resin can be dissolved. Since the solvent in which both of the first resin and the second resin can be dissolved is used, the second intermediate layer 11 and the first intermediate layer 9 can be patterned into the first plane shape by the one patterning process without executing the patterning process twice by changing the solvent on the way of the process like a system of two stages as mentioned above. The second intermediate layer 11 and the first intermediate layer 9 can be also patterned into the first plane shape by the patterning process of one stage by a sandblast method or a dry etching method. That is, by executing the patterning process by the sandblast method or the dry etching method after the mask was formed onto the second intermediate layer 11, the second intermediate layer 11 and the first intermediate layer 9 can be patterned into the first plane shape. Further, the second intermediate layer 11 and the first intermediate layer 9 can be also simultaneously patterned into the first plane shape by a doctor blade method of scraping off the surplus second intermediate layer 11 and first intermediate layer 9 by a comb-tooth-shaped or scoop-shaped blade.

In the case of executing the step (E) by the wet etching method, as a solvent which is used for this process, a proper one of substances similar to those mentioned as a first solvent which forms the solution of the first resin can be selected.

[6] Step (F)

The step (F) is a step wherein the first intermediate layer or the second intermediate layer which has been patterned into the first plane shape is patterned into a second plane shape which is thinner than the first plane shape by the wet etching method. In this wet etching, a solvent in which the first resin can be dissolved and the second resin cannot be dissolved or a solvent in which the first resin cannot be dissolved and the second resin can be dissolved is used.

Figure 8:
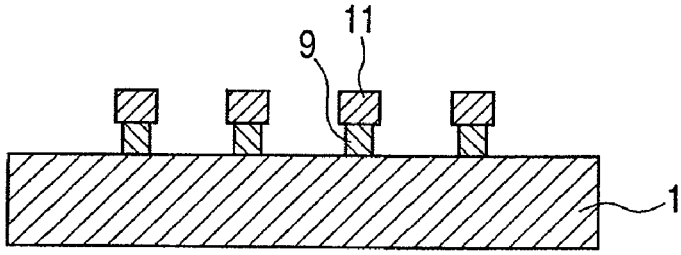
FIG. 8 is a descriptive diagram of a step (F) in the first method of the invention.

First, in the case of using the solvent in which the first resin can be dissolved and the second resin cannot be dissolved, since the portion of the first intermediate layer 9 illustrated in FIG. 7 is etched, the portion of the first intermediate layer 9 is thinned into the second plane shape which is thinner than the first plane shape and enters a state as illustrated in FIG. 8. That is, a laminated layer obtained by laminating the second intermediate layer 11 of the first plane shape that is thicker than the first intermediate layer 9 onto the first intermediate layer 9 of the thin second plane shape is formed. Assuming that the step (E) is executed by the system of the two stages, the step (F) using the solvent in which the first resin can be dissolved and the second resin cannot be dissolved can be executed by continuing the wet etching of the second stage after the second intermediate layer 11 was patterned into the first plane shape.

Figure 9:
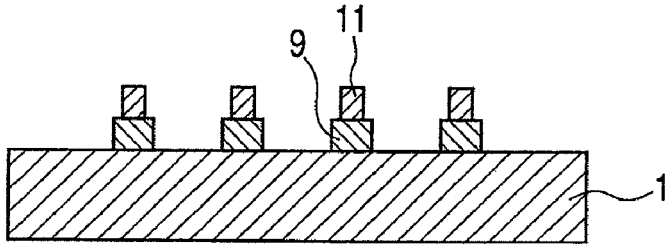
FIG. 9 is a descriptive diagram of the step (F) in the first method of the invention.

In the case of using the solvent in which the first resin cannot be dissolved and the second resin can be dissolved, since the portion of the second intermediate layer 11 illustrated in FIG. 7 is etched, the portion of the second intermediate layer 11 is thinned into the second plane shape which is thinner than the first plane shape and enters a state as illustrated in FIG. 9. That is, a laminated layer obtained by laminating the second intermediate layer 11 of the second plane shape that is thinner than the first intermediate layer 9 onto the first intermediate layer 9 of the thick first plane shape is formed. In the case of etching the second intermediate layer 11 so as to have the second plane shape, when the mask is formed onto the upper surface of the second intermediate layer 11 in the step (E), it is desirable to leave it and prevent a fluctuation in height of the second intermediate layer 11. A step of newly forming a mask onto the upper surface of the second intermediate layer 11 can be also added to the step (F).

As a solvent in which the first resin can be dissolved and the second resin cannot be dissolved or a solvent in which the first resin cannot be dissolved and the second resin can be dissolved which is used in the wet etching method of the step (F), a proper one of substances similar to those mentioned as a first solvent which forms the solution of the first resin can be selected.

In the invention, a state where the second plane shape is thinner than the first plane shape denotes that in the case where each of the first intermediate layer 9 and the second intermediate layer 11 is formed into an elongated plate shape or a wall shape, a thickness of second plane shape is smaller than that of the first plane shape. It also means that when each of the first intermediate layer 9 and the second intermediate layer 11 is formed into a columnar shape, a diameter of second plane shape is smaller than that of the first plane shape.

Further, a state where the first plane shape is thicker than the second plane shape denotes that in the case where each of the first intermediate layer 9 and the second intermediate layer 11 is formed into an elongated plate shape or a wall shape, a thickness of first plane shape is larger than that of the second plane shape. It also means that when each of the first intermediate layer 9 and the second intermediate layer 11 is formed into a columnar shape, a diameter of first plane shape is larger than that of the second plane shape.

[7] Step (G)

The step (G) is a step of baking a pattern of the laminated layer of the first intermediate layer 9 of the second or first plane shape and the second intermediate layer 11 of the first or second plane shape.

The baking can be executed in the atmosphere containing oxygen (ambient atmosphere). It is desirable that a baking temperature is set to a temperature within a range from 300° C. or more to 700° C. or less although it depends on the first resin, the second resin, and the spacer material in the first and second compositions. A baking time can be ordinarily set to 24 hours or shorter. It is desirable to execute the baking at a temperature within a range from 350° C. or more to 650° C. or less and for a period of time within a range from 5 minutes or longer to 5 hours or shorter in consideration of an extinction from a target due to the combustion of the first and second resins, a melting temperature of the spacer material, a manufacturing efficiency, or the like.

Figure 10:
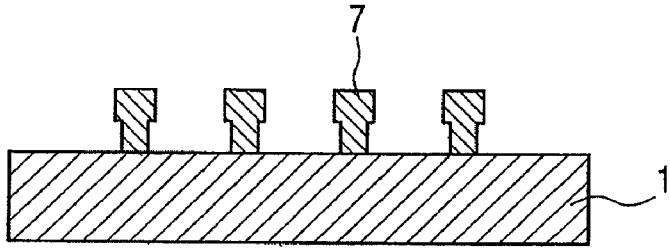
FIG. 10 is a diagram illustrating an example of a cross sectional shape of the spacer formed by the first method of the invention through a step (G).
Figure 11:
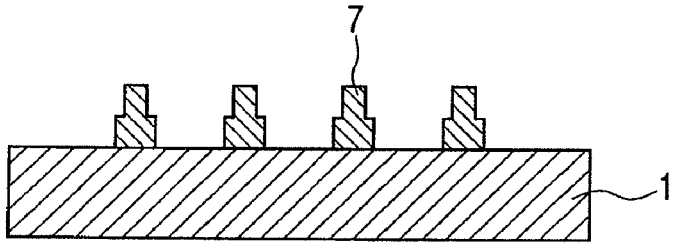
FIG. 11 is a diagram illustrating another example of the cross sectional shape of the spacer formed by the first method of the invention through the step (G).

By the baking, the first and second resins in the first intermediate layer 9 and the second intermediate layer 11 are extinguished and the spacer 7 as illustrated in FIG. 10 or 11 is formed by the fused and integrated spacer material. The spacer 7 in the first example has the elongated plate shape or the wall shape. The spacer illustrated in the diagram has a cross sectional shape which was cut in the width direction. FIG. 10 illustrates a cross sectional shape of the spacer 7 in the case where the first intermediate layer 9 has been patterned into the second plane shape in the step (F). FIG. 11 illustrates a cross sectional shape of the spacer 7 in the case where the second intermediate layer 11 has been patterned into the second plane shape in the step (F).

Since the spacer 7 is formed on the substrate 1 constructing the rear plate in the example, in the case of the spacer 7 in FIG. 10, a lower surface of the convex portion faces the substrate 1 almost in parallel with the surface of the substrate 1. Therefore, even if the electron directly enters this surface from the electron-emitting source 3 described in FIG. 1, the emission of the secondary electron can be suppressed. In the case of the spacer 7 in FIG. 11, although an upper surface of the convex portion is almost parallel with the surface of the substrate 1, it faces the substrate 2 constructing the face plate described in FIG. 1. Therefore, the emission of the secondary electron in the case where the electron emitted from the electron-emitting source 3 described in FIG. 1 was reflected by the face plate side and entered this surface can be suppressed.

In the case where the spacer 7 was formed on the substrate 2 (refer to FIG. 1) constructing the face plate, the lower surface of the convex portion of the spacer 7 in FIG. 10 faces the substrate 2 constructing the face plate. Therefore, the emission of the secondary electron in the case where the electron emitted from the electron-emitting source 3 described in FIG. 1 was reflected by the face plate side and entered this surface is suppressed. In the case of the spacer 7 in FIG. 11, although the upper surface of the convex portion is almost parallel with the surface of the substrate 2, it faces the substrate 1 constructing the rear plate described in FIG. 1. Therefore, the emission of the secondary electron in the case where the electron directly entered this surface from the electron-emitting source 3 described in FIG. 1 is suppressed.

Subsequently, a second example of a manufacturing method of the spacer according to the invention will be described with reference to FIGS. 1 to 5 and 12 to 17.

As already described as steps (A) to (D) in FIGS. 1 to 5, the first composition is applied onto the substrate 1 and the coating film 8 is dried, thereby forming the first intermediate layer 9. Further, the second composition is applied onto the first intermediate layer 9 and the coating film 10 is dried, thereby forming the second intermediate layer 11.

Subsequently, after executing the step (A') of applying the first composition onto the second intermediate layer 11 locating on the uppermost surface, the steps (B) to (D) are repeated. The step (A') which is executed after the steps (A) to (D) and the steps (B) to (D) are sequentially executed once or repetitively executed a plurality of times, thereby obtaining a state illustrated in FIG. 12. The state illustrated in FIG. 12 is a state obtained by sequentially repeating the step (A') and the steps (B) to (D) twice.

Figure 12:
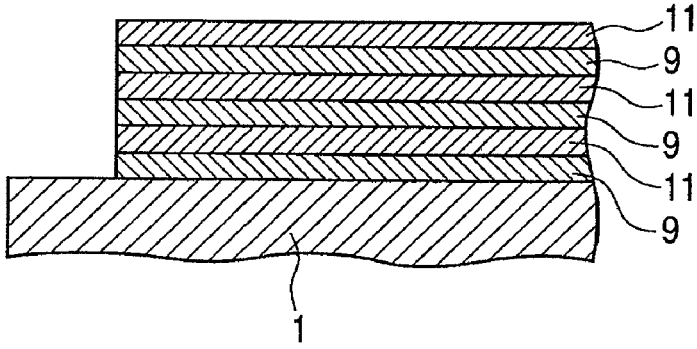
FIG. 12 is a diagram illustrating a laminating state of a first intermediate layer and a second intermediate layer in a second method of the invention.
Figure 13:
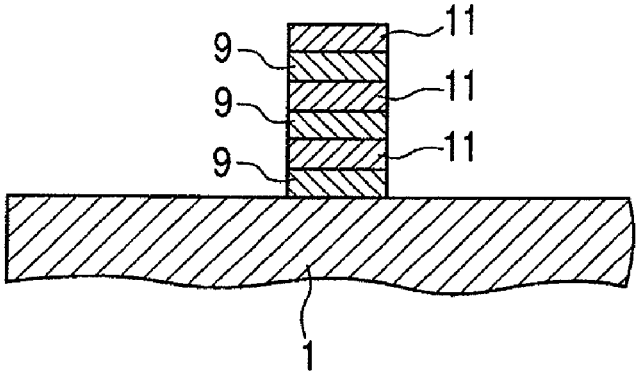
FIG. 13 is a descriptive diagram of a step (E) in the second method of the invention.

After a laminated layer illustrated in FIG. 12 was formed, a process of the step (E) of the one-stage system is executed, thereby obtaining the laminated layer of the first plane shape as illustrated in FIG. 13. That is, the laminated layer of the first intermediate layers 9 and the second intermediate layers 11 which were alternately laminated every three layers is patterned into the first plane shape in the step (E) of the one-stage system.

After the step (E) of the one-stage system was executed, the step (F) is executed. In a manner similar to that mentioned above, each of the first intermediate layers 9 and the second intermediate layers 11 which were patterned into the first plane shape is patterned into the second plane shape that is thinner than the first plane shape. In the case of patterning each of the first intermediate layers 9 into the second plane shape, the solvent in which the first resin can be dissolved and the second resin cannot be dissolved is used. In the case of patterning each of the second intermediate layers 11 into the second plane shape, the solvent in which the first resin cannot be dissolved and the second resin can be dissolved is used.

In the first example mentioned above, since the first composition is not applied onto the second intermediate layer 11, even if the second resin can or cannot be dissolved to the first solvent contained in the first composition, the shape of the spacer 7 which is finally obtained is the same. However, in the second example, since the first composition is applied onto the second intermediate layer 11, the shape of the spacer 7 which is obtained differs depending on whether the second resin can or cannot be dissolved to the first solvent. Such a difference appears in the step (F).

Figure 14:
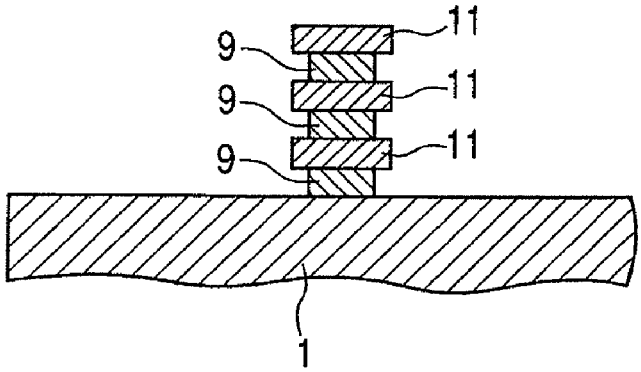
FIG. 14 is a descriptive diagram of a step (F) in the second method of the invention.
Figure 15:
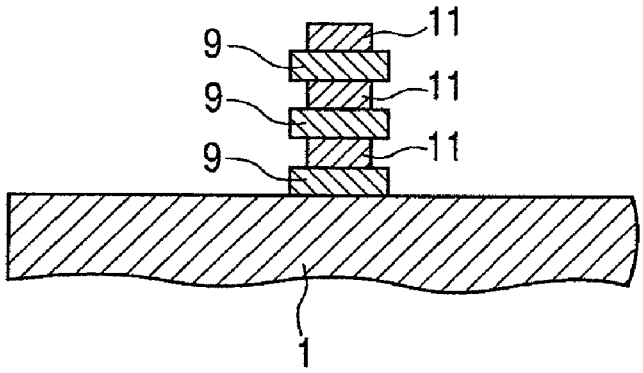
FIG. 15 is a descriptive diagram of the step (F) in the second method of the invention.

First, in the case where the second resin cannot be dissolved to the first solvent, when the first composition is applied onto the second intermediate layer 11, since the second resin is not dissolved to the first solvent, the first resin and the second resin are not mixed. Therefore, an interface between the second resin in the second intermediate layer 11 and the first resin in the first intermediate layer 9 adjacent to the upper side of the second resin becomes clear. Since the first resin cannot be dissolved to the second solvent as mentioned above, an interface between the first resin in the first intermediate layer 9 and the second resin in the second intermediate layer 11 adjacent to the upper side of the first resin is also clear. Therefore, when the wet etching of the step (F) is executed, as illustrated in FIGS. 14 and 15, the concave/convex portions in which all corner portions are sharp are formed. FIG. 14 illustrates the case where each of the first intermediate layers 9 was patterned into the second plane shape by the solvent in which the first resin can be dissolved and the second resin cannot be dissolved. FIG. 15 illustrates the case where each of the second intermediate layers 11 was patterned into the second plane shape by the solvent in which the first resin cannot be dissolved and the second resin can be dissolved.

On the other hand, in the case where the second resin can be dissolved to the first solvent, when the first composition is applied onto the second intermediate layer 11, the second resin near the surface of the second intermediate layer 11 is dissolved to the first solvent. The first resin and the second resin are mixed near the interface between the second intermediate layer 11 and the first intermediate layer 9 adjacent to the upper side of the second resin. Therefore, the following shape is obtained.

Figure 16:
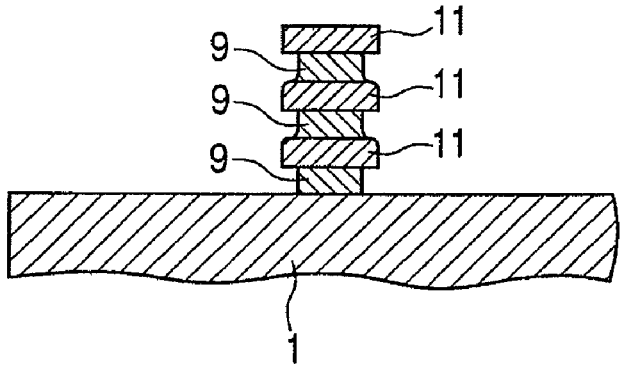
FIG. 16 is a descriptive diagram of the step (F) in the second method of the invention.

That is, in the case where the step (F) was executed by the solvent in which the first resin can be dissolved and the second resin cannot be dissolved, as illustrated in FIG. 16, each of a corner portion on the outside of the upper surface of the second intermediate layer 11 as a convex portion and a corner portion between the second intermediate layer 11 and the first intermediate layer 9 adjacent to the upper side thereof becomes a rounded shape. The upper surface of the second intermediate layer 11 as a convex portion is liable to be inclined to the outside. However, a lower surface of the second intermediate layer 11 as a convex portion is almost horizontal to the surface of the substrate 1 and a corner portion on the lower surface side is sharp.

Figure 17:
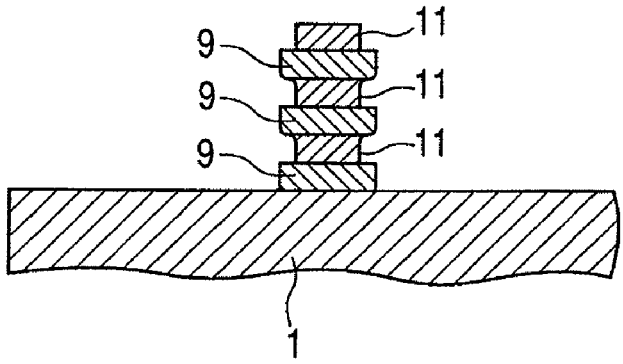
FIG. 17 is a descriptive diagram of the step (F) in the second method of the invention.

In the case where the step (F) was executed by the solvent in which the first resin cannot be dissolved and the second resin can be dissolved, as illustrated in FIG. 17, each of a corner portion on the outside of the lower surface of the second intermediate layer 11 as a convex portion and the corner portion between the second intermediate layer 11 and the first intermediate layer 9 adjacent to the upper side thereof becomes a rounded shape. The lower surface of the second intermediate layer 11 as a convex portion is liable to be inclined to the outside. However, the upper surface of the second intermediate layer 11 as a convex portion is almost horizontal to the surface of the substrate 1 and a corner portion on the upper surface side is sharp.

After the step (F) was executed, the step (G) of baking a pattern of a laminated layer in a state where the first intermediate layers 9 of the second or first plane shape and the second intermediate layers 11 of the first or second plane shape have alternately been laminated is executed. Baking conditions are similar to those mentioned above.

Figure 18:
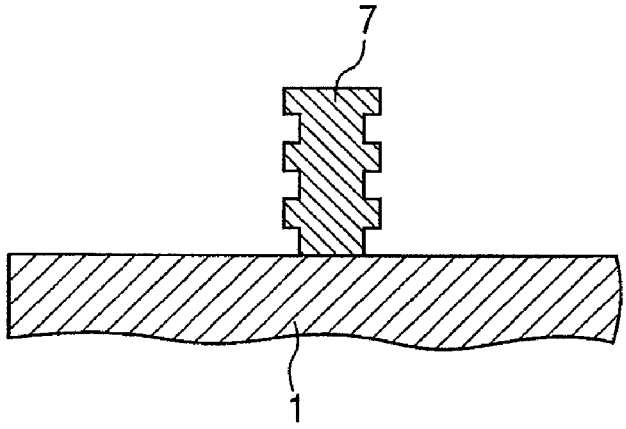
FIG. 18 is a diagram illustrating an example of a cross sectional shape of the spacer formed by the first method of the invention through the step (G).
Figure 19:
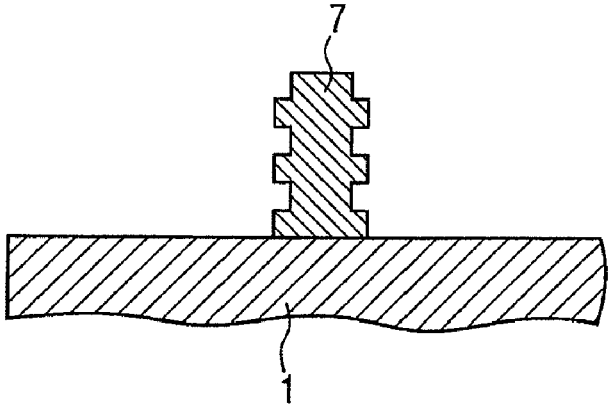
FIG. 19 is a diagram illustrating another example of the cross sectional shape of the spacer formed by the first method of the invention through the step (G).
Figure 20:
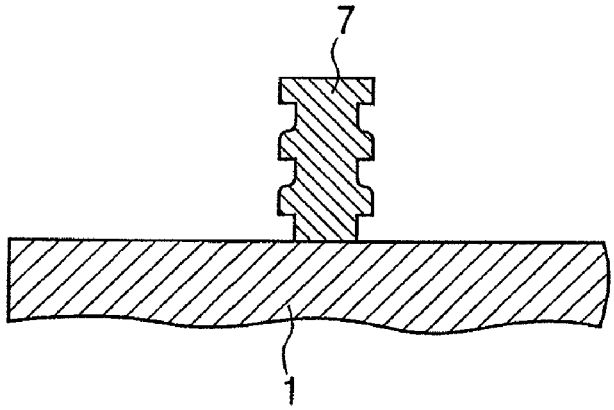
FIG. 20 is a diagram illustrating another example of the cross sectional shape of the spacer formed by the first method of the invention through the step (G) and is a diagram for describing a definition of an angle.
Figure 21:
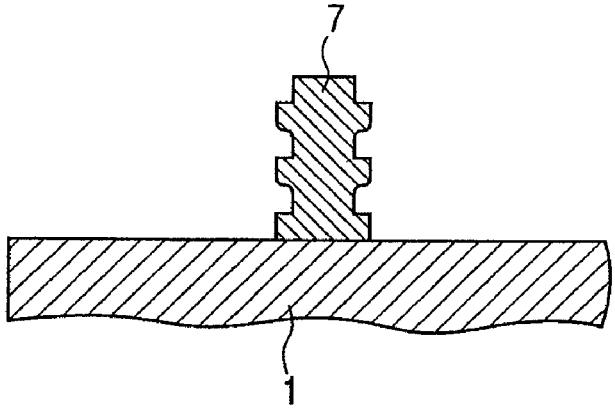
FIG. 21 is a diagram illustrating another example of the cross sectional shape of the spacer formed by the first method of the invention through the step (G).

By the baking, the first resin and the second resin in the first intermediate layer 9 and the second intermediate layer 11 are extinguished and the spacer 7 as illustrated in FIGS. 18 to 21 is formed by the fused and integrated spacer material. The spacer 7 in the second example has the elongated plate shape or the wall shape. The spacer illustrated in the diagrams has a cross sectional shape which was cut in the width direction. FIG. 18 illustrates the spacer 7 obtained by the laminated layer illustrated in FIG. 14. FIG. 19 illustrates the spacer 7 obtained by the laminated layer illustrated in FIG. 15. FIG. 20 illustrates the spacer 7 obtained by the laminated layer illustrated in FIG. 16. FIG. 21 illustrates the spacer 7 obtained by the laminated layer illustrated in FIG. 17.

According to the spacers 7 in FIGS. 18 and 19, upper and lower surfaces of a convex portion are almost horizontal to the surface of the substrate 1, and both of a corner on the outside of the convex portion and a corner between the convex portion and the concave portion are sharp. Therefore, a long creepage distance can be obtained and the generation of the secondary electron can be suppressed for both of the electron which enters directly from the electron-emitting source 3 illustrated in FIG. 1 and the electron which is reflected and enters from the substrate 2 side constructing the face plate, so that the above construction is desirable. According to the spacers 7 in FIGS. 20 and 21, the lower surface or the upper surface of a convex portion is almost horizontal to the surface of the substrate 1, and both of a corner on the lower surface side or the upper surface on the outside of the convex portion and a corner between the lower surface or the upper surface of the convex portion and the concave portion are sharp. Therefore, a creepage distance can be extended as compared with that in the case where the concave/convex portions run wavily, and the generation of the secondary electron can be suppressed for either the electron which enters directly from the electron-emitting source 3 illustrated in FIG. 1 or the electron which is reflected and enters from the substrate 2 side constructing the face plate.

Although the spacer 7 has been formed on the substrate 1 constructing the rear plate in the second example, the spacer 7 may be formed on the substrate 2 constructing the face plate in a manner similar to the first example.

Although the same material may be used as spacer materials in the first composition and the second composition in the first and second examples, different materials can be also used. For example, in the case where an insulating material is used as a spacer material in the first composition, an electroconductive material is used as a spacer material in the second composition, and the spacer 7 having a cross sectional shape as illustrated in FIG. 9 or 18 is formed, such an advantage of improvement of a bulk discharge voltage can be obtained.

Figure 22:
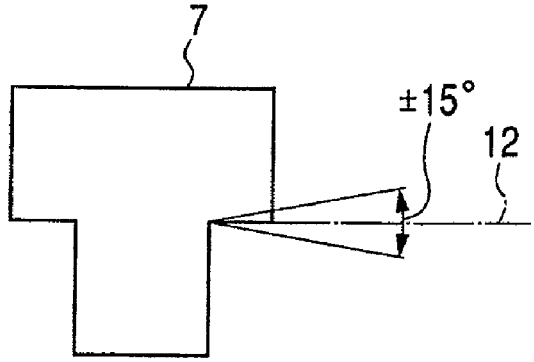
FIG. 22 is a descriptive diagram of a surface which is almost parallel with a substrate surface in the invention.

It is desirable that the upper surface or the lower surface of the convex portion of the spacer 7 is formed almost in parallel with the surface of the substrate 1 or 2 forming the spacer 7 so that the emission of the secondary electron accompanied with the incidence of the electron can be suppressed. In the specification, "almost in parallel with the surface of the substrate 1 or 2" denotes "within a range of ±15° from a reference surface 12 which is parallel with the surface of the substrate 1 or 2" as illustrated in FIG. 22. As for a projection amount of the convex portion as an interval between a bottom surface portion of the concave portion and a front edge portion of the convex portion, it is desirable that the projection amount lies within a range from 1 to 500 μm so that the creepage distance is extended and the generation of the secondary electron can be easily suppressed.

In the invention, "can be dissolved or cannot be dissolved to a certain solvent" denotes as follows. That is, it is defined in such a manner that in the case where the solvent is blown to the resin solid at an ordinary temperature of 27 to 30° and at a projecting pressure of 0.2 MPa, when a surface position of the resin solid which was fused and moved backward for one minute is located at a distance of 1 μm or less from an initial position, such a resin solid cannot be dissolved to the solvent, and when the surface position is located at a distance of 10 μm or more, such a resin solid can be dissolved to the solvent. Such a distance is called "solubility".

EXAMPLES

The invention will be described hereinbelow with respect to specific Examples. However, the invention is not limited by them.

Example 1

Step (A)

The following first composition is applied onto a substrate of soda lime glass by the spin coating method, thereby forming a coating film having a thickness of 80 μm.

Spacer material: borosilicate lead glass ($PbO—B_2O_3—SiO_2$), 100 weight parts

First resin: ethylcellulose, 15 weight parts

First solvent: diethyleneglycol monobutyl ether acetate, 40 weight parts

Additive: $SiO_2$, 10 weight parts

Step (B)

The substrate on which the coating film of the first composition has been formed in the step (A) is put onto a hot plate and the coating film is dried at 120° C. for 20 minutes, thereby obtaining a first intermediate layer.

Step (C)

The following second composition is applied onto the first intermediate layer obtained in the step (B) by the spin coating method, thereby forming a coating film having a thickness of 40 μm. A solubility of the first resin to the second solvent is less than 0.1%.

Spacer material: borosilicate lead glass ($PbO—B_2O_3—SiO_2$), 100 weight parts

Second resin: water-soluble acryl, 4 weight parts

Second solvent: Mixture liquid of water of 50 weight % and ethanol of 50 weight %, 40 weight parts Additive: $SiO_2$, 10 weight parts Step (D)

The substrate obtained by forming the coating film of the second composition onto the first intermediate layer in the step (C) is put onto the hot plate and the coating film is dried at 120° C. for 20 minutes, thereby obtaining a second intermediate layer.

Step (E)

A laminated layer obtained by laminating the second intermediate layer onto the first intermediate layer is patterned into the first plane shape by the sandblast method.

First, a dry film resist (BF45Z manufactured by Tokyo Ohka Kogyo Co., Ltd.) is adhered onto the laminated layer. A photomask of the first plane shape is arranged onto the dry film resist, exposed by ultraviolet rays at a power of 200 mJ, and developed by an aqueous solution containing sodium carbonate of 0.1 weight %, thereby forming a mask. After the development, a sandblast is executed and the laminated layer is patterned into the first plane shape. The sandblast is executed by blowing sandblast powder of A1203 # No. 1000 at a pressure of 0.3 MPa and at a rate of a feed amount of 100 g/min.

The remaining mask after completion of the sandblast is removed.

Step (F)

Terpineol is used as a solvent. By blowing such a solvent at an injection pressure of 0.1 MPa for 10 minutes while circulating it, the first intermediate layer is dissolved. While allowing the second intermediate layer to maintain the first plane shape, the first intermediate layer is patterned into the second plane shape. A solubility of the first resin (ethylcellulose) to terpineol is equal to 130 μm and a solubility of the second resin (water-soluble acryl) is less than 1 μm.

Step (G)

The laminated layer constructed by the first intermediate layer of the second plane shape and the second intermediate layer of the first plane shape obtained by step (F) is baked. The baking is executed in an atmosphere containing oxygen of 20 weight % at an arrival temperature of 520° C. for one hour.

By the steps (A) to (G) mentioned above, the spacer as illustrated in FIG. 10 is obtained. The lower surface of the convex portion of the obtained spacer is almost parallel with the surface of the substrate and each corner portion is an almost right-angled sharp corner.

Comparison 1

A spacer is formed in a manner similar to that of Example 1 except that the second composition of Example 1 is replaced by the following composition. A solubility of the first resin (ethylcellulose) to the second solvent (texanol) is equal to 40 μm.

Spacer material: borosilicate lead glass ($PbO—B_2O_3—SiO_2$), 100 weight parts

Second resin: acrylic resin, 15 weight parts

Second solvent: Texanol, 40 weight parts

Additive: $SiO_2$, 10 weight parts

Figure 23:
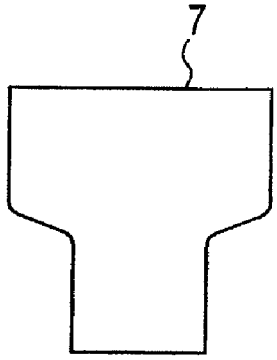
FIG. 23 is a cross sectional view of a spacer formed in Comparison 1.
Figure 24:
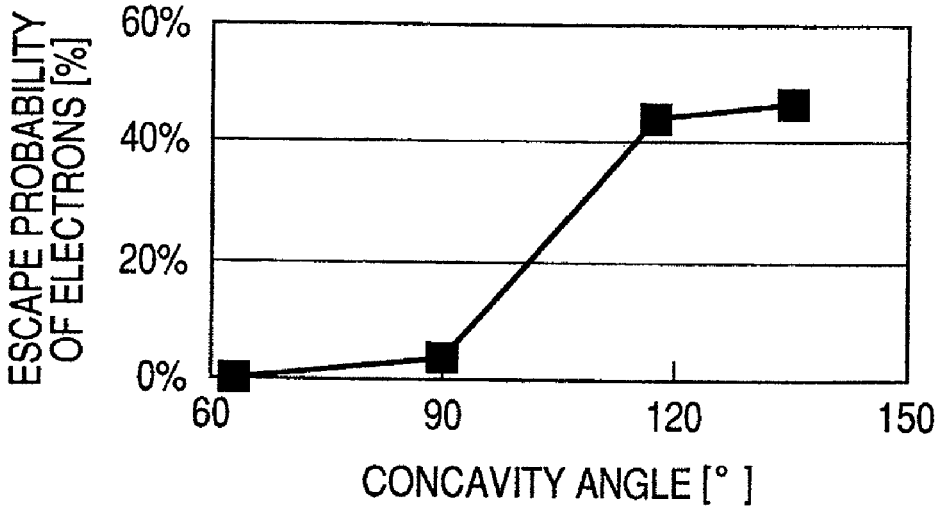
FIG. 24 is a diagram illustrating a relation between a concavity angle and an escape probability of electrons.

The obtained spacer has a cross sectional shape as illustrated in FIG. 23, a lower surface of a convex portion is largely inclined from the surface of the substrate, and each of a corner portion on the outside of the lower surface of the convex portion and a corner portion between the lower surface of the convex portion and the concave portion has a rounded portion. The concave portion and the convex portion are gently connected.

Example 2

A spacer is formed in a manner similar to that of Example 1 except that the solvent in step (F) shown in Example 1 is replaced by the water. A solubility of the first resin (ethylcellulose) to the water is less than 1 μm and a solubility of the second resin (water-soluble acryl) is equal to 60 μm.

The obtained spacer has a cross sectional shape as illustrated in FIG. 11, an upper surface of a convex portion is almost parallel with the surface of the substrate and each corner portion is an almost right-angled sharp corner.

Example 3

After the steps (A) to (D) shown in Example 1 were sequentially executed, the step (A') of applying the first composition onto the second intermediate layer and the steps (B) to (D) are repeated twice. After that, the steps (E) to (G) in Example 1 are executed, thereby forming a spacer. A solubility of the second resin (water-soluble acryl) to the first solvent (diethyleneglycol monobutyl ether acetate) is equal to 20 μm.

The obtained spacer has a cross sectional shape as illustrated in FIG. 20, a lower surface of a convex portion is almost horizontal to the surface of the substrate and each of a corner on the outside of the lower surface of the convex portion and a corner between the lower surface of the convex portion and a concave portion is sharp.

Example 4

The first composition used in the step (A) shown in Example 1 is replaced by the following composition.

Spacer material: borosilicate lead glass ($PbO—B_2O_3—SiO_2$), 100 weight parts

First resin: water-soluble acryl, 30 weight parts

First solvent: Mixture liquid of water of 50 weight % and ethanol of 50 weight %, 40 weight parts Additive: $SiO_2$, 10 weight parts The second composition used in the step (C) shown in Example 1 is replaced by the following composition.

Spacer material: borosilicate lead glass ($PbO—B_2O_3—SiO_2$), 100 weight parts

Second resin: water-soluble acryl, 30 weight parts

Second solvent: diethyleneglycol monobutyl ether acetate, 40 weight parts

Additive: $SiO_2$, 10 weight parts

Further, the solvent used in step (F) shown in Example 1 is replaced by the water. A solubility of the first resin (water-soluble acryl) to the second solvent (diethyleneglycol monobutyl ether acetate) is equal to 20 μm. A solubility to the water is equal to 60 μm. A solubility of the second resin (ethylcellulose) to the first solvent (mixture liquid of the water of 50 weight % and ethanol of 50 weight %) is less than 1 μm and a solubility to the water is less than 1 μm.

A spacer is formed in a manner similar to that of Example 3 without changing the steps shown in Example 1 other than the above points.

The obtained spacer has a cross sectional shape as illustrated in FIG. 21, an upper surface of a convex portion is almost horizontal to the surface of the substrate and each of a corner on the outside of the upper surface of the convex portion and a corner between the upper surface of the convex portion and a concave portion is sharp.

Example 5

A spacer is formed in a manner similar to that of Example 3 without changing the steps shown in Example 1 except that the second composition used in the step (C) shown in Example 1 is replaced by the following composition. Both of a solubility of the second resin (polyvinylalcohol) to the first solvent (diethyleneglycol monobutyl ether acetate) and a solubility of that to the solvent (terpionel) in the step (F) are equal to 1 μm or less.

Spacer material: borosilicate lead glass ($PbO—B_2O_3—SiO_2$), 100 weight parts

Second resin: polyvinylalcohol, 5 weight parts

Second solvent: Mixture liquid of water of 50 weight % and ethanol of 50 weight %, 40 weight parts Additive: $SiO_2$, 10 weight parts The obtained spacer has a cross sectional shape as illustrated in FIG. 18, an upper surface and a lower surface of a convex portion are almost horizontal to the surface of the substrate and all corners are sharp.

Example 6

A spacer is formed in a manner similar to that of Example 5 except that the spacer material of the second composition used in the step (C) shown in Example 1 is replaced by borosilicate zinc glass ($ZnO—B_2O_3—SiO_2$).

The obtained spacer has a cross sectional shape as illustrated in FIG. 18, a convex portion is made of borosilicate zinc glass, and a concave portion is made of borosilicate lead glass.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-145297, filed Jun. 3, 2008, which is hereby incorporated by reference herein in its entirety.

What is claimed is:

1. A method of forming a spacer on a substrate constituting an electron-beam light-emitting display panel, the method comprising:

applying a first composition on the substrate, wherein the first composition includes a spacer material and a first resin solution which contains a first solvent and a first resin dissolved in the first solvent;

forming a first intermediate layer by removing the first solvent from the first composition;

applying a second composition on the first intermediate layer, wherein the second composition includes a spacer material and a second resin solution which contains a second solvent and a second resin dissolved in the second solvent in which the first resin is insoluble;

forming a second intermediate layer by removing the second solvent from the second composition so as to form a laminated layer of the first intermediate layer and the second intermediate layer;

patterning one of the first intermediate layer and the second intermediate layer, wherein the patterning is executed by a wet etching method which makes a lateral surface of the laminated layer contact with a solvent in which one of the first resin and the second resin is soluble and the other of the first resin and the second resin is insoluble, such that the one of the first intermediate layer and the second intermediate layer has a smaller cross-sectional area parallel to the substrate than the other of the first intermediate layer and the second intermediate layer, and a patterned laminated layer having a concave portion and a convex portion along the lateral surface respectively corresponding to the one of the first intermediate layer and the second intermediate layer and the other of the first intermediate layer and the second intermediate layer is formed; and baking the patterned laminated layer to remove the first resin and the second resin from the patterned laminated layer.

2. The method according to claim 1, wherein, after the each of the applying and forming steps are sequentially performed, a step of applying the first composition onto the second intermediate layer at an uppermost surface is performed.

3. The method according to claim 1, wherein a solvent in which the second resin cannot be dissolved is used as the first solvent.

4. The method according to claim 1, wherein the spacer material of the first composition and the spacer material of the second composition are different from each other.

* * * * *